US008214203B2

(12) United States Patent
Sung et al.

(10) Patent No.: US 8,214,203 B2
(45) **Date of Patent: *Jul. 3, 2012**

(54) METHOD AND APPARATUS FOR RECOVERING LINE SPECTRUM PAIR PARAMETER AND SPEECH DECODING APPARATUS USING SAME

(75) Inventors: Hosang Sung, Youngin-si (KR); Seungho Choi, Seoul (KR); Kihyun Choo, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/659,943

(22) Filed: Mar. 25, 2010

(65) Prior Publication Data

US 2010/0191523 A1 Jul. 29, 2010

Related U.S. Application Data

(63) Continuation of application No. 11/347,429, filed on Feb. 6, 2006, now Pat. No. 7,765,100.

(30) Foreign Application Priority Data

Feb. 5, 2005 (KR) ..... 10-2005-0010992

(51) Int. Cl.

| | |
|---|---|
| ***G10L 11/00*** | (2006.01) |
| ***G10L 19/14*** | (2006.01) |
| ***G10L 13/00*** | (2006.01) |
| ***G10L 13/06*** | (2006.01) |
| ***G10L 19/00*** | (2006.01) |

(52) U.S. Cl. ..... 704/219; 704/202; 704/205; 704/265; 704/266; 704/500

(58) Field of Classification Search ..... 704/219, 704/202, 205, 265, 266, 500

See application file for complete search history.

(56) References Cited

U.S. PATENT DOCUMENTS 5,615,298 A 3/1997 Chen (Continued)

FOREIGN PATENT DOCUMENTS

EP 0 718 982 6/1996

(Continued)

OTHER PUBLICATIONS

Perkins, C.et al. "A Survey of Packet Loss Recovery Techniques for Streaming Audio" in IEEE Network Magazine, Sep. 1998, Vo112, Issue 5, pp. 40-48.*

(Continued)

*Primary Examiner* — Douglas Godbold
*Assistant Examiner* — Edgar Guerra-Erazo
(74) *Attorney, Agent, or Firm* — Staas & Halsey LLP

(57) ABSTRACT

A method and an apparatus for recovering a line spectrum pair (LSP) parameter of a spectrum region when frame loss occurs during speech decoding and a speech decoding apparatus adopting the same are provided. The method of recovering an LSP parameter in speech decoding includes: if it is determined that a received speech packet has an erased frame, converting an LSP parameter of a previous good frame (PGF) of the erased frame or LSP parameters of the PGF and a next good frame (NGF) of the erased frame into a spectrum region and obtaining a spectrum envelope of the PGF or spectrum envelopes of the PGF and NGF; recovering a spectrum envelope of the erased frame using the spectrum envelope of the PGF or the spectrum envelopes of the PGF and NGF; and converting the recovered spectrum envelope of the erased frame into an LSP parameter of the erased frame. The method and apparatus can improve the quality of a recovered speech signal, be applied to a variety of technologies, and provide a method of recovering an LSP parameter for development of an algorithm for speech decoding.

27 Claims, 9 Drawing Sheets

U.S. PATENT DOCUMENTS

| | | | | |
|---|---|---|---|---|
| 5,699,478 | A * | 12/1997 | Nahumi | 704/226 |
| 5,806,027 | A | 9/1998 | George et al. | |
| 5,907,822 | A | 5/1999 | Prieto, Jr. | |
| 6,205,130 | B1 * | 3/2001 | DeJaco | 370/335 |
| 6,377,914 | B1 | 4/2002 | Yeldener | |
| 6,597,961 | B1 * | 7/2003 | Cooke | 700/94 |
| 6,665,637 | B2 | 12/2003 | Bruhn | |
| 6,665,638 | B1 | 12/2003 | Kang et al. | |
| 6,691,082 | B1 | 2/2004 | Aguilar et al. | |
| 6,775,649 | B1 | 8/2004 | DeMartin | |
| 6,952,668 | B1 * | 10/2005 | Kapilow | 704/206 |
| 7,027,989 | B1 * | 4/2006 | Tapadar et al. | 704/270 |
| 7,117,156 | B1 | 10/2006 | Kapilow | |
| 7,269,553 | B2 | 9/2007 | Kang et al. | |
| 7,324,937 | B2 | 1/2008 | Thyssen et al. | |
| 7,519,535 | B2 * | 4/2009 | Spindola | 704/266 |
| 2001/0044727 | A1 | 11/2001 | Nakatoh et al. | |
| 2002/0091523 | A1 | 7/2002 | Makinen et al. | |
| 2003/0074197 | A1 | 4/2003 | Chen | |
| 2005/0154584 | A1 | 7/2005 | Jelinek et al. | |
| 2006/0173687 | A1 * | 8/2006 | Spindola | 704/265 |
| 2006/0206318 | A1 | 9/2006 | Kapoor et al. | |
| 2007/0027683 | A1 | 2/2007 | Sung et al. | |
| 2008/0249766 | A1 | 10/2008 | Ehara | |

FOREIGN PATENT DOCUMENTS

| | | | |
|---|---|---|---|
| WO | WO 98/06090 | | 2/1998 |
| WO | 99/66494 | | 12/1999 |
| WO | WO 02/35520 | * | 5/2002 |

OTHER PUBLICATIONS

De Martin, J.C.; Unno, T.; Viswanathan, V.;, "Improved frame erasure concealment for CELP-based coders," Acoustics, Speech, and Signal Processing, 2000. ICASSP '00. Proceedings. 2000 IEEE International Conference on, vol. 3, no., pp. 1483-1486 vol. 3, 2000.*

Craig R. Watkins et al., "Improving 16 KB/S G.728 LD-CELP Speech Coder for Frame Erasure Channels", International Conference on Acoustics, Speech, and Signal Processing, May 9-12, 1995, Detroit, MI, USA, IEEE US, vol. 1, May 1995, pp. 241-244,.

Mi Suk Lee et al., (2004). "A Forward-Backward Packet Loss Concealment Algorithm for Multimedia over IP Network Services." Springer-Verlag Berlin Heidelberg Feb. 2004, Korea.

U.S. Office Action mailed May 26, 2009 in parent U.S. Appl. No. 11/347,429.

U.S. Final Office Action mailed Dec. 23, 2009 in parent U.S. Appl. No. 11/347,429.

U.S. Notice of Allowance Mar. 15, 2010 in parent U.S. Appl. No. 11/347,429.

May 26, 2009 Form PTO-892 from parent applicatino citing WO 98/06090.

Examiner initialed PTO-1449 indicating consideration of May 26, 2009 Office Action from the parent application.

* cited by examiner

METHOD AND APPARATUS FOR RECOVERING LINE SPECTRUM PAIR PARAMETER AND SPEECH DECODING APPARATUS USING SAME

CROSS-REFERENCE TO RELATED APPLICATIONS

This application is a continuation of application Ser. No. 11/347,429 filed on Feb. 6, 2006 now U.S. Pat. No. 7,765,100, which claims the priority of Korean Patent Application No. 10-2005-0010992, filed on Feb. 5, 2005, in the Korean Intellectual Property Office, the disclosure of which is incorporated herein by reference.

BACKGROUND OF THE INVENTION

1. Field of the Invention

The present invention relates to a method and an apparatus for recovering a line spectrum pair (LSP) parameter for speech decoding, and more particularly, to a method and an apparatus for recovering an LSP parameter when frame loss occurs and a speech decoding apparatus using the same.

2. Description of the Related Art

To transmit data in a limited bandwidth environment, a speech coding apparatus does not transmit an actual speech signal but extracts parameters representing the speech signal, encodes the extracted parameters, and generates a speech packet including the coded parameters. A speech decoding apparatus decodes the coded parameters included in the generated speech packet and recovers the speech signal using the decoded parameters.

A line spectrum pair (LSP) parameter is one parameter representing the speech signal. The LSP parameter has good coding characteristics since it is closely related to a speech frequency. Most speech coding apparatuses generate the LSP parameter, code the generated LSP parameter, and speech decoding apparatuses decode the coded LSP parameter.

However, to remove an error from a received speech packet, speech coding apparatuses usually check the received speech packet and, if it is determined that the received speech packet has an error, erase the speech packet. Such erasure of a speech packet causes loss of the LSP parameter and breaking of the recovered speech signal.

To solve such problems, a method of recovering the lost LSP parameter in speech decoding has been proposed.

FIG. 1 illustrates a conventional method of recovering an LSP parameter based on the International Telecommunication Union (ITU) G.729 standard. The conventional method illustrated in FIG. 1 is an extrapolation method in which the LSP parameter LSP(m) (or an LSP vector) of a previous good frame (PGF) is not corrected but the LSP parameter LSP(m) is used for L subsequent erased frames.

However, since the same speech signal is recovered for the L frames, continuity between a speech signal recovered for the L subsequent erased frames and a speech signal recovered based on a next good frame (NGF) deteriorates.

FIG. 2 illustrates another conventional method of recovering LSP parameters. The method illustrated in FIG. 2 is an interpolation method in which the LSP parameter of the PGF and the LSP parameter of a next good frame (NGF) received is used after erasing L subsequent frames is used.

The letter w denotes a weight and is determined as a value from 0 to 1 according to the number of the erased frames and whether transmission position of erased frames approaches the PGF or the NGF. Accordingly, the LSP parameter of the L erased frames generated using the LSP parameters of the PGF and the NGF have different values LSP(m+1) . . . LSP(m+x) . . . LSP (m+L).

However, since the LSP parameters are recovered in an LSP parameter region, it is difficult to define a spectrum region, develop an algorithm, and apply the method to a variety of technologies.

BRIEF SUMMARY

An aspect of the present invention provides a method and an apparatus for recovering a line spectrum pair (LSP) parameter in a spectrum region when frame loss occurs during speech decoding and a speech decoding apparatus.

According to an aspect of the present invention, there is provided a method of recovering a line spectrum pair (LSP) parameter for speech decoding, the method including: (a) converting an LSP parameter of a previous good frame (PGF) of an erased frame into a spectrum region to obtain a spectrum envelope of the PGF, when it is determined that a received speech packet has an erased frame; (b) recovering a spectrum envelope of the erased frame using the obtained spectrum envelope of the PGF; and (c) converting the recovered spectrum envelope of the erased frame into an LSP parameter of the erased frame.

According to another aspect of the present invention, there is provided a method of recovering a line spectrum pair (LSP) parameter in speech decoding, the method including: (a) converting an LSP parameter of a previous good frame (PGF) of an erased frame and an LSP parameter of a next good frame (NGF) of the erased frame into spectrum regions and obtaining spectrum envelopes of the PGF and NGF, when it is determined that a received speech packet has an erased frame; (b) recovering a spectrum envelope of the erased frame using the spectrum envelopes of the PGF and the NGF; and (c) converting the recovered spectrum envelope of the erased frame into an LSP parameter of the erased frame.

According to still another aspect of the present invention, there is provided an apparatus for recovering a line spectrum pair (LSP) parameter during speech decoding, the apparatus including: a first converter, when it is determined that a received speech packet has an erased frame, receiving an LSP parameter of a previous good frame (PGF) of the erased frame and converting the received LSP parameter of the PGF into a spectrum region of the PGF, and obtaining a spectrum envelope of the PGF; a spectrum recovering unit recovering a spectrum envelope of the erased frame using the spectrum envelope of the PGF; and a second converter converting the spectrum envelope of the erased frame into an LSP parameter of the erased frame.

According to yet another aspect of the present invention, there is provided an apparatus for recovering a line spectrum pair (LSP) parameter in speech decoding, the apparatus including: a first converter, when it is determined that a received speech packet has an erased frame, converting an LSP parameter of a previous goof frame (PGF) of the erased frame into a spectrum region and obtaining a spectrum envelope of the PGF; a second converter, when it is determined that the received speech packet has an erased frame, converting an LSP parameter of a next good frame (NGF) of the erased frame into a spectrum region and obtaining a spectrum envelope of the NGF; a recovering unit recovering a spectrum envelope of the erased frame using the spectrum envelopes of the PGF and the NGF; and a third converter converting the recovered spectrum envelope of the erased frame into an LSP parameter region of the erased frame.

According to further another aspect of the present invention, there is provided an speech decoding apparatus, including: an excitation signal decoder decoding parameters of a current frame and outputting an excitation signal; a line spectrum pair (LSP) parameter decoder decoding an LSP parameter of the current frame; a frame erasure concealment unit, when a received coded speech packet has an erased frame, recovering an LSP parameter of the erased frame and the excitation signal of the erased frame using parameters of a previous good frame (PGF) or parameters of the PGF and a next goof frame (NGF) of the erased frame in order to conceal the erasure of the erased frame; a parameter transmitter, when the received coded speech packet does not have an erased frame, transmitting the parameters of the current frame to the excitation signal decoder and the LSP parameter decoder and, if the received coded speech packet has the erased frame, transmitting the parameters of the PGF of the erased frame or the parameters of the PGF and the NGF of the erased frame to the frame erasure concealment unit; a converter converting the decoded LSP parameters transmitted from the LSP parameter decoder or the LSP parameter transmitted from the frame erasure concealment unit into an LPC; and a combination filter receiving the excitation signal output from the excitation signal decoder or the excitation signal output from he frame erasure concealment unit and outputting a combined speech signal using the LPC output from the converter.

According to other aspects of the present invention, there are provided computer-readable recording media encoded with processing instructions for causing a processor to execute the aforementioned methods of the present invention.

Additional and/or other aspects and advantages of the present invention will be set forth in part in the description which follows and, in part, will be obvious from the description, or may be learned by practice of the invention.

BRIEF DESCRIPTION OF THE DRAWINGS

The above and/or other aspects and advantages of the present invention will become apparent and more readily appreciated from the following detailed description, taken in conjunction with the accompanying drawings of which.

DETAILED DESCRIPTION OF EMBODIMENTS

Figure 1:
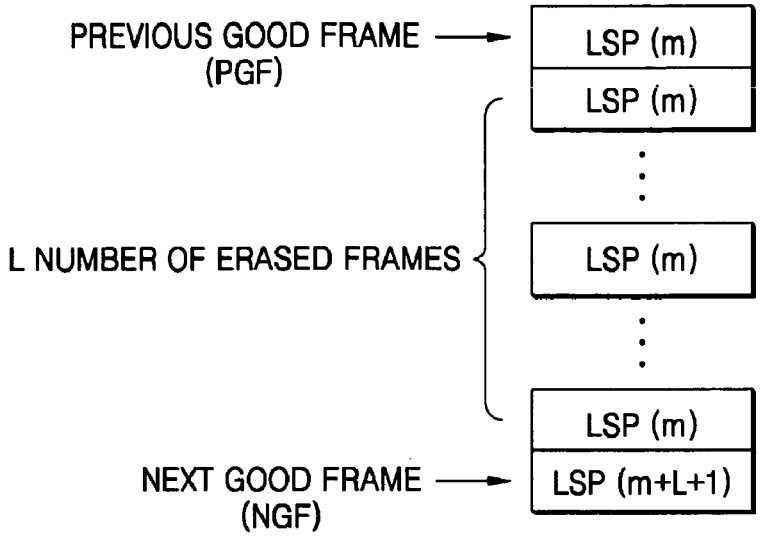
FIG. 1 (PRIOR ART)
FIG. 1 illustrates a conventional method of recovering a line spectrum pair (LSP) parameter.
Figure 2:
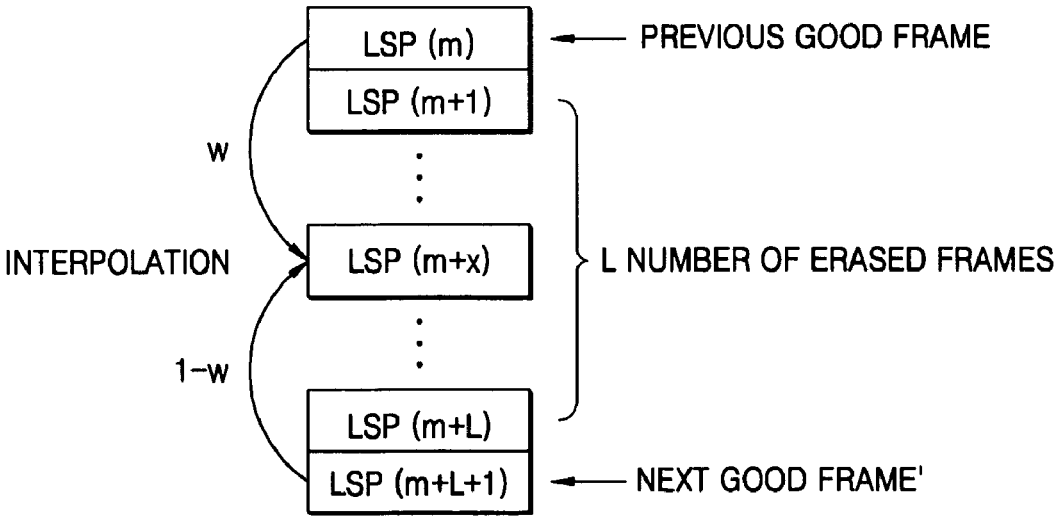
FIG. 2 (PRIOR ART)
FIG. 2 illustrates another conventional method of recovering a LSP parameter.

Reference will now be made in detail to embodiments of the present invention, examples of which are illustrated in the accompanying drawings, wherein like reference numerals refer to the like elements throughout. The embodiments are described below in order to explain the present invention by referring to the figures.

Figure 3:
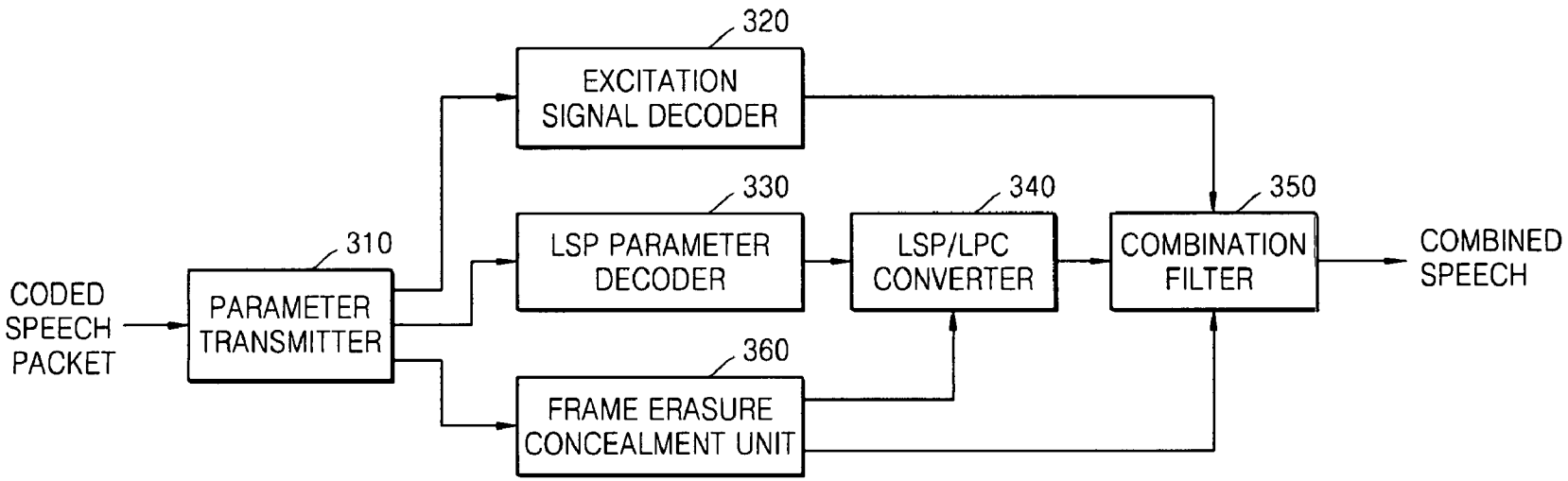
FIG. 3 is a block diagram of a speech decoding apparatus including an apparatus for recovering an LSP parameter according to an embodiment of the present invention.

FIG. 3 is a block diagram of a speech decoding apparatus including an apparatus for recovering an LSP parameter according to an embodiment of the present invention. Referring to FIG. 3, the speech decoding apparatus includes a parameter transmitter 310, an excitation signal decoder 320, an LSP parameter decoder 330, a LSP/linear predictive coefficient (LPC) converter 340, a combination filter 350, and a frame erasure concealment unit 360.

A coded speech packet is input to the parameter transmitter 310 after an error check is performed, in which frames with errors are erased from the input coded speech packet.

The parameter transmitter 310 checks each of the frames of the input coded speech packet and transmits parameters included in the speech packet according to whether the frame is erased (or lost). If the speech packet is not received for a predetermined time, the parameter transmitter 310 can determine that frames included in a section corresponding to the predetermined time have been erased.

If the input coded speech packet is a good frame, the parameter transmitter 310 transmits to the excitation signal decoder 320 parameters necessary for decoding an excitation signal among parameters included in the received speech packet and transmits an LSP parameter (or an LSP coefficient) having ten roots to the LSP parameter decoder 330.

If the speech decoding apparatus is a code-excited linear prediction (CELP) speech decoding apparatus, the parameters necessary for decoding the excitation signal may include a pitch used for an adaptive codebook, a codebook index used for a fixed codebook, a gain value $g_p$ of the adaptive codebook, and a gain value $g_c$ of the fixed codebook.

The excitation signal decoder 320 decodes input parameters and outputs the excitation signal. The output excitation signal is transmitted to the combination filter 350. The LSP parameter decoder 330 decodes the input LSP parameter. The decoded LSP parameter is transmitted to the LSP/LPC converter 340. The LSP/LPC converter 340 converts the decoded LSP parameter into an LPC parameter. The converted LPC parameter is transmitted to the combination filter 350.

The combination filter 350 combination-filters the excitation signal using the LPC parameter and outputs a synthesis speech signal. The output synthesis speech signal is a recovered speech signal.

However, if the frame is erased (or lost), the parameter transmitter 310 transmits the LSP parameter of the previous good frame (PGF) or the LSP parameters of the PGF and the next good frame (NGF), and the parameters for decoding the excitation signal to the frame erasure concealment unit 360 in order to recover an LSP parameter of the erased (or lost) frame.

The frame erasure concealment unit 360 can recover the LSP parameter of the erased frame using an extrapolation method or an interpolation method with recovering the excitation signal.

Figure 4:
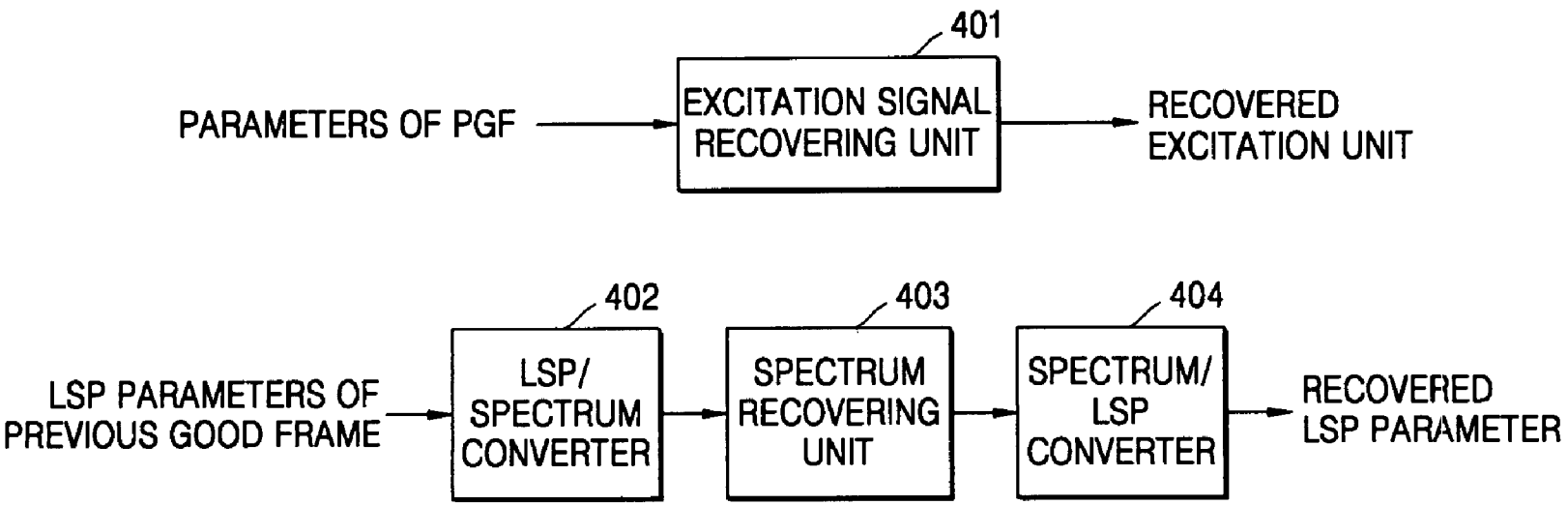
FIG. 4 is a block diagram of a frame erasure concealment unit of the speech decoding apparatus shown in FIG. 3 according to an embodiment of the present invention.

FIG. 4 is a block diagram of the frame erasure concealment unit 360 shown in FIG. 3 using an the extrapolation method to recover the LSP parameter of the erased frame. Referring to FIG. 4, the frame erasure concealment unit 360 includes an excitation signal recovering unit 401, an LSP/spectrum converter 402, a spectrum recovering unit 403, and a spectrum/LSP converter 404.

The excitation signal recovering unit 401 receives the parameters for generating the excitation signal of the PGF transmitted from the parameter transmitter 310 of FIG. 3 and recovers the excitation signal of the erased frame using the received parameters. The excitation signal recovering unit 401 can recover the excitation signal based on the ITU G.729 standard. The recovered excitation signal is transmitted to the combination filter 350 of FIG. 3.

The LSP/spectrum converter 402 receives an LSP parameter having ten roots of the PGF from the parameter transmitter 310 of FIG. 3, converts the received LSP parameter into a spectrum region, and obtains a spectrum envelope of the PGF. The obtained spectrum envelope of the PGF is transmitted to the spectrum recovering unit 403.

The spectrum recovering unit 403 transforms the spectrum envelope of the PGF using a predetermined method and recovers a spectrum envelope of the erased frame. The erased frame may be a current frame. The predetermined method can define, for example, so that the spectrum envelope of the PGF is spectral shifted to a predetermined region. The predetermined region is a low frequency region or a high frequency region to be shifted by degrees.

The spectrum recovering unit 403 transforms the spectrum envelope of the PGF using a weight determined according to the correlation between the erased frame and the PGF and outputs the transformed spectrum envelope as the recovered spectrum envelope of the erased frame.

The spectrum/LSP converter 404 receives the recovered spectrum envelope of the erased frame and converts the recovered spectrum envelope into an LSP parameter of the erased frame. The LSP parameter is then transmitted to the LSP/LPC converter 340 of FIG. 3.

The LSP/spectrum converter 402 can convert the LSP parameter of the PGF into an LPC parameter, convert the LPC parameter into a Cepstrum of the PGF, and convert the Cepstrum into the spectrum region. In this case, the spectrum/LSP converter 404 can convert the recovered spectrum envelope of the erased frame into a Cepstrum of the erased frame, convert the Cepstrum into the LPC parameter of the erased frame, and convert the LPC parameter into the LSP parameter of the erased frame.

Alternatively, the LSP/spectrum converter 402 can convert the LSP parameter of the PGF into the LPC parameter and convert the LPC parameter into the spectrum region. In this case, the spectrum/LSP converter 404 can convert the recovered spectrum envelope of the erased frame into an autocorrelation coefficient (ACC) parameter of the erased frame, convert the ACC parameter into the LPC parameter of the erased frame, and convert the LPC parameter into the LSP parameter of the erased frame.

Alternatively, the LSP/spectrum converter 402 can convert the LSP parameter of the PGF into the LPC parameter, convert the LPC parameter into the Cepstrum of the PGF, and convert the Cepstrum into the spectrum region. In this case, the spectrum/LSP converter 404 can convert the recovered spectrum envelope of the erased frame into the ACC parameter of the erased frame, convert the ACC parameter into the LPC parameter of the erased frame, and convert the LPC parameter into the LSP parameter of the erased frame.

Alternatively, the LSP/spectrum converter 402 can convert the LSP parameter of the PGF into a pseudo_cepstrum (PCEP) of the PGF and convert the PCEP into the spectrum region. In this case, the spectrum/LSP converter 404 converts the recovered spectrum envelope of the erased frame into the PCEP of the erased frame and converts the PCEP into the LSP parameter of the erased frame.

An apparatus for recovering the LSP parameter of the erased frame according to an embodiment of the present invention shown in FIG. 4 may include the LSP/spectrum converter 402, the spectrum recovering unit 403, and the spectrum/LSP converter 404.

Figure 5:
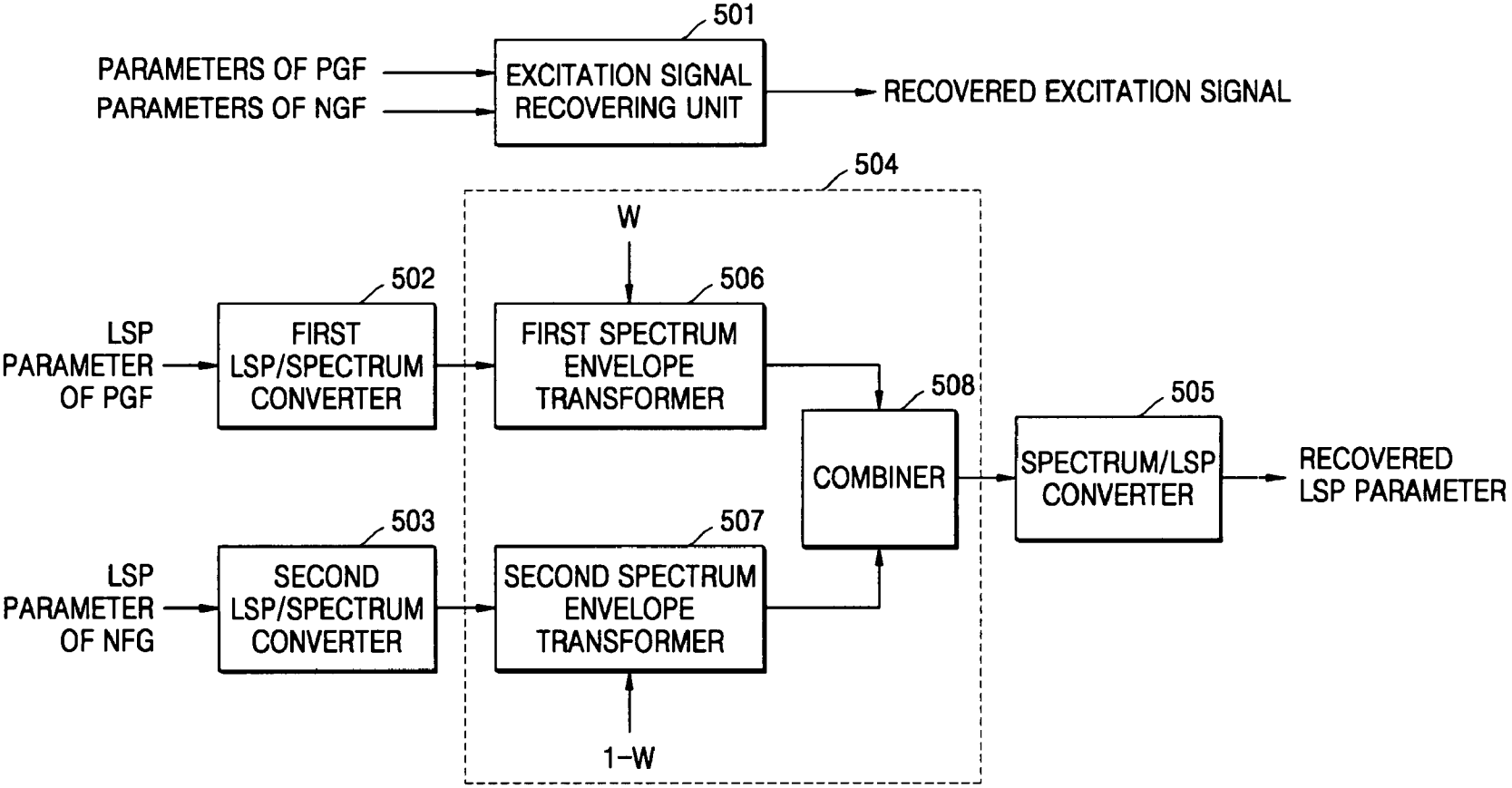
FIG. 5 is another block diagram of the frame erasure concealment unit of the speech decoding apparatus shown in FIG. 3 according to another embodiment of the present invention.

FIG. 5 is a block diagram of the frame erasure concealment unit 360 shown in FIG. 3 when recovering the LSP parameter of the erased frame using an interpolation method with recovering an excitation signal. Referring to FIG. 5, the frame erasure concealment unit 360 includes an excitation signal recovering unit 501, a first LSP/spectrum converter 502, a second LSP/spectrum converter 503, a recovering unit 504, and a spectrum/LSP converter 505.

The apparatus for recovering the LSP parameter of the erased frame according to an embodiment of the present invention shown in FIG. 5 may include the first LSP/spectrum converter 502, the second LSP/spectrum converter 503, the recovering unit 504, and the spectrum/LSP converter 505.

The excitation signal recovering unit 501 receives the parameters for generating excitation signals of the PGF and the NGF transmitted from the parameter transmitter 310 of FIG. 3 and recovers the excitation signal of the erased frame using the received parameters. The excitation signal recovering unit 501 can recover the excitation signal based on the ITU G.729 standard. The recovered excitation signal is transmitted to the combination filter 350 of FIG. 3.

The first LSP/spectrum converter 502 receives an LSP parameter having ten roots of the PGF from the parameter transmitter 310 of FIG. 3, converts the received LSP parameter into a spectrum region, and obtains a spectrum envelope of the PGF. As in the first LSP/spectrum converter 402 of FIG. 4, the first LSP/spectrum converter 502 converts the LSP parameter into the spectrum region using one of four conversion methods described above. The obtained spectrum envelope of the PGF is transmitted to the recovering unit 504.

The second LSP/spectrum converter 503 receives an LSP parameter having ten roots of the NGF from the parameter transmitter 310 of FIG. 3, converts the received LSP parameter of the NGF into a spectrum region, and obtains a spectrum envelope of the NGF. As in the first LSP/spectrum converter 402 of FIG. 4, the second LSP/spectrum converter 503 converts the LSP parameter into the spectrum region using one of four conversion methods described above. The first and second LSP/spectrum converters 502 and 503 use the same conversion method. The obtained spectrum envelope of the NGF is transmitted to the recovering unit 504.

The recovering unit 504 includes a first spectrum envelope transformer 506, a second spectrum envelope transformer 507, and a combiner 508.

The first spectrum envelope transformer 506 transforms the spectrum envelope of the PGF using a weight determined according to the correlation between the erased frame and the PGF, the correlation between the erased frame and the NGF, and the number of erased frames. The correlation is determined based on the proximity of the erased frame to the PGF and the NGF. The weight has a value from 0 to 1. If the erased frame is closer to the PGF, an input weight of the first spectrum envelope transformer 506 is greater than an input weight of the second spectrum envelope transformer 507. For example, if the input weight of the first spectrum envelope transformer 506 is w, the input weight of the second spectrum envelope transformer 507 is 1-w.

The second spectrum envelope transformer 507 transforms the spectrum envelope of the NGF using the weight.

The combiner 508 combines the transformed spectrum envelope of the PGF received from the first spectrum envelope transformer 506 and the spectrum envelope of the NGF received from the second spectrum envelope transformer 507. Such a combination may result in obtaining the sum of the two transformed spectrum envelopes. The combined spectrum envelope is the recovered spectrum envelope of the erased frame.

The spectrum/LSP converter 505 receives the spectrum envelope of the erased frame and converts the spectrum envelop into the LSP parameter. The LSP parameter is transmitted to the LSP/LPC converter 340. With the spectrum/LSP converter 404 of FIG. 4, the spectrum/LSP converter 505 performs an inverse operation of the first and second LSP/spectrum converters 502 and 503.

Figure 6:
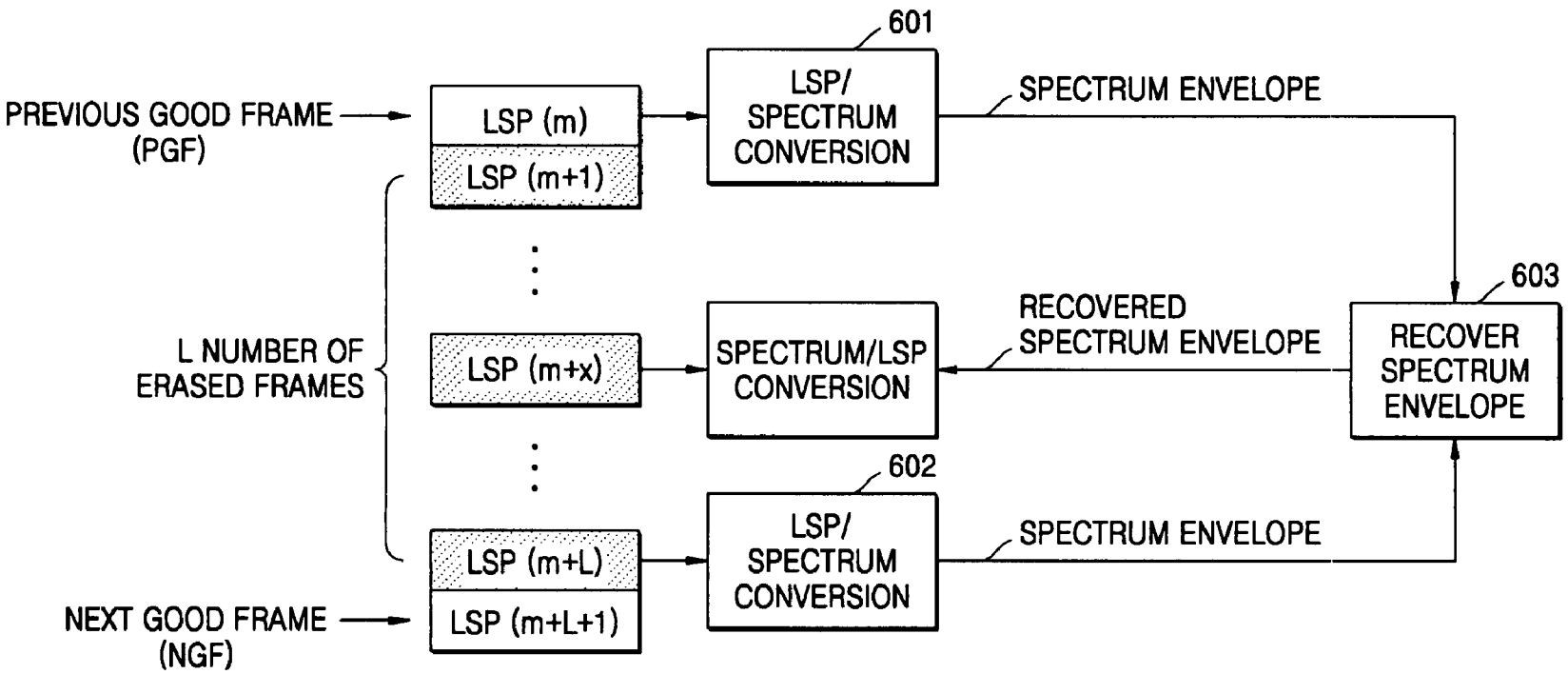
FIG. 6 is a block diagram illustrating the operation of an apparatus for recovering the LSP parameter illustrated in FIG. 5.

FIG. 6 is a block diagram illustrating the operation of the apparatus for recovering the LSP parameter illustrated in FIG. 5. Referring to FIG. 6, when there are L erased frames between the PGF and the NGF, the LSP parameter of the PGF is converted into a spectrum region (Operation 601), the LSP parameter of the NGF is converted into a spectrum region (Operation 602), and the spectrum envelope of the PGF and the spectrum envelope of the NGF are transformed and combined, thereby recovering the spectrum envelope of the erased frame (Operation 603). The recovered spectrum envelope is converted into the LSP parameter, and the LSP parameter is provided as the LSP parameter of the erased frame. The spectrum envelope of the PGF and the spectrum envelope of the NGF are transformed using the weight per a frame determined according to the correlation between the erased frame and the PGF/NGF, and the number of erased frames. The correlation is determined based on the proximity of the erased frame to the PGF and the NGF.

Figure 7:
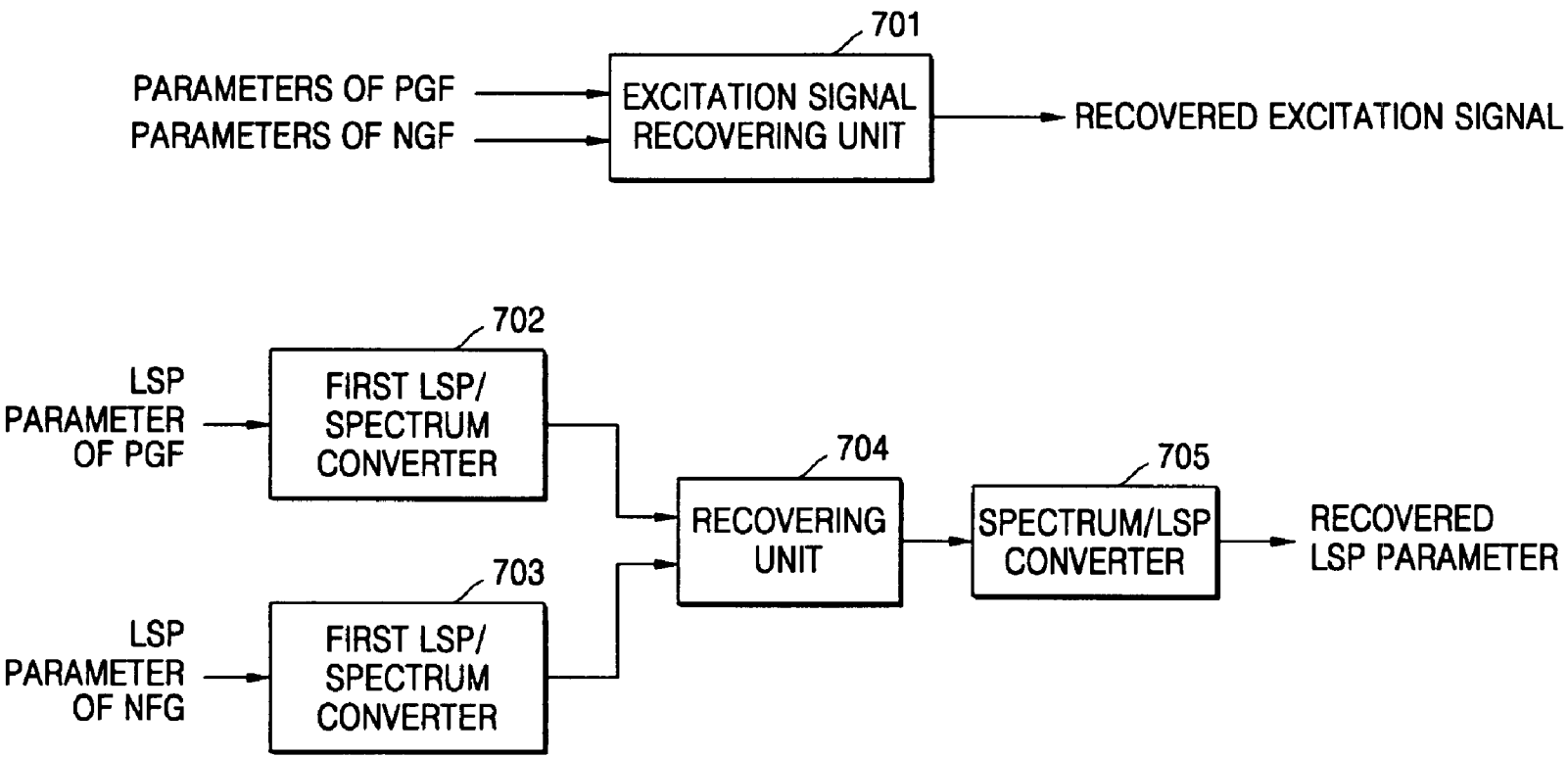
FIG. 7 is a block diagram of the frame erasure concealment unit of the speech decoding apparatus shown in FIG. 3 according to another embodiment of the present invention.

FIG. 7 is a block diagram of the frame erasure concealment unit 360 shown in FIG. 3 in recovering the LSP parameter of the erased frame using an interpolation method. An excitation signal recovering unit 701, a first LSP/spectrum converter 702, a second LSP/spectrum converter 703, and a spectrum/LSP converter 705 shown in FIG. 7 are not described since they are respectively the same as the excitation signal recovering unit 501, the first LSP/spectrum converter 502, the second LSP/spectrum converter 503, and the spectrum/LSP converter 505 shown in FIG. 5.

Referring to FIG. 7, a recovering unit 704 nonlinearly matches a band of a spectrum envelope of the PGF output from the first LSP/spectrum converter 702 and a band of a spectrum envelope of the NGF output from the second LSP/spectrum converter 703 using a dynamic programming method and recovers the spectrum envelope of the erased frame.

Figure 8:
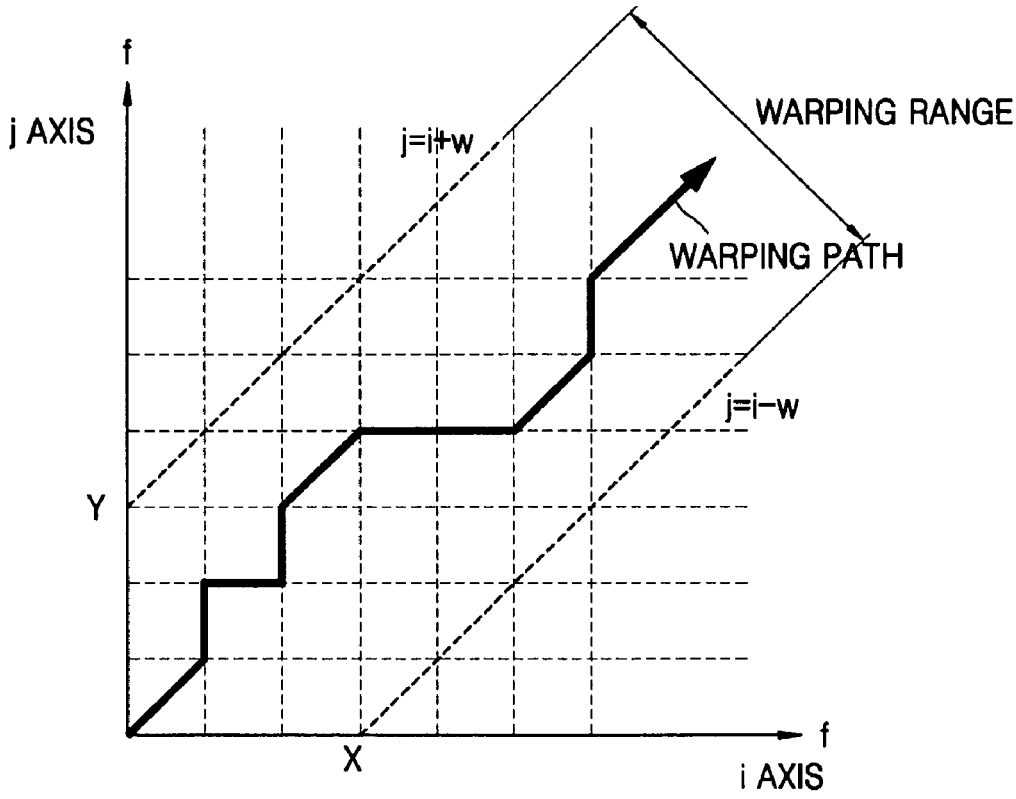
FIG. 8 is a graph of a warping path and a warping range obtained using a dynamic frequency warping (DFW) method in a recovering unit of the frame erasure concealment unit shown in FIG. 7 and a warping range.

The recovering unit 704 nonlinearly matches the spectrum bands of the PGF and the NGF using a dynamic frequency warping (DFW) method, obtains a warping path and recovers the spectrum envelope of the erased frame based on the obtained warping path as shown in FIG. 8.

FIG. 8 is a graph of the warping path and the warping range obtained using the DFW method in the recovering unit 704 shown in FIG. 7. Referring to FIG. 8, the warping range is determined by the obtained warping path.

Figure 9:
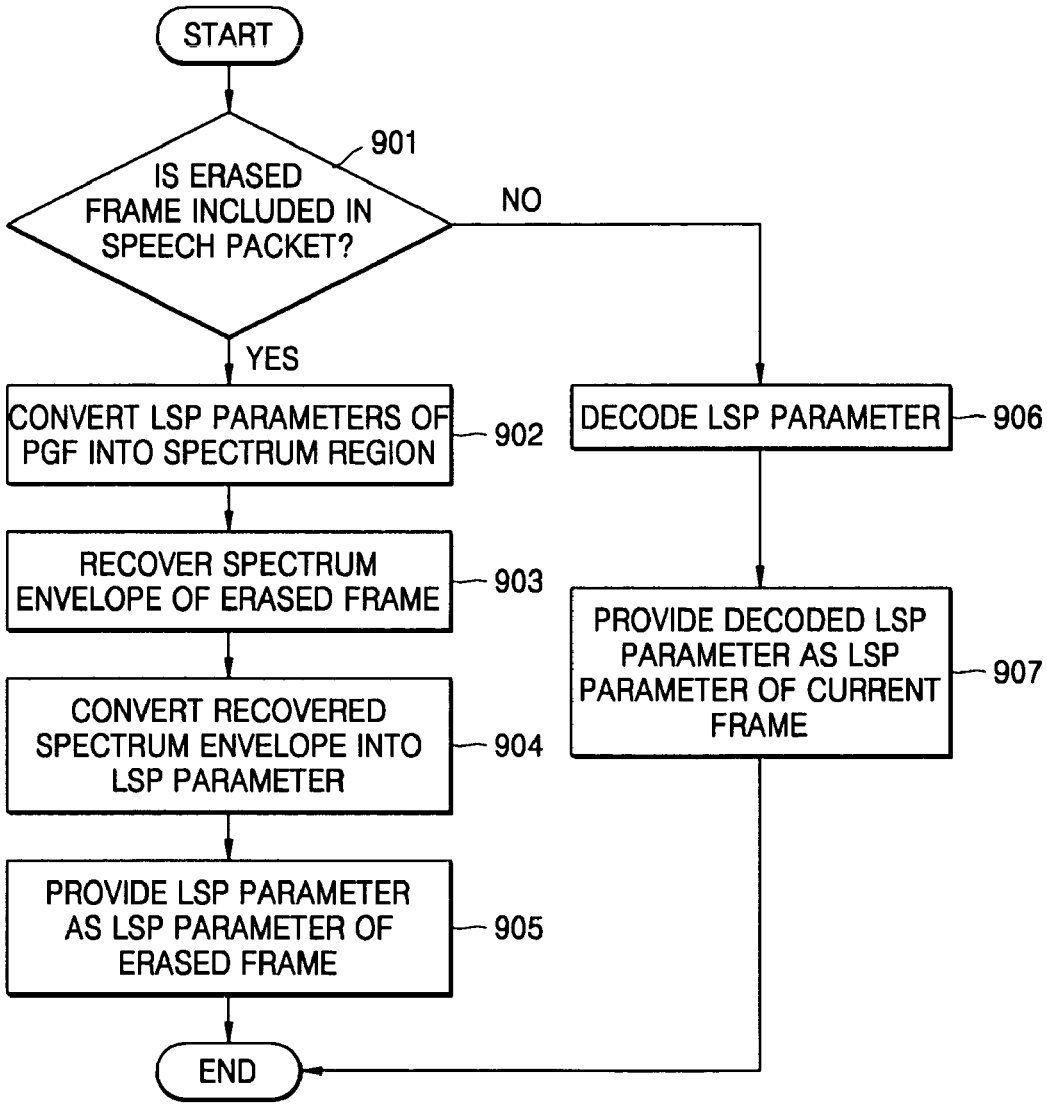
FIG. 9 is a flowchart of a method of recovering an LSP parameter according to an embodiment of the present invention.

FIG. 9 is a flowchart of a method of recovering an LSP parameter according to an embodiment of the present invention. Referring to FIG. 9, if it is determined that a received speech packet has an erased frame during speech decoding (Operation 901), an LSP parameter of a PGF is converted into a spectrum range to obtain a spectrum envelope of the PGF (Operation 902).

The obtained spectrum envelope of the PGF is transformed using one of four conversion methods as described above for the spectrum recovering unit 403 of FIG. 4 and the spectrum envelope of the erased frame is recovered (Operation 903).

The recovered spectrum envelope of the erased frame is converted into an LSP parameter (Operation 904) and the LSP parameter is provided as a recovered LSP parameter of the erased frame (Operation 905).

One of four conversion methods as described above for the LSP/spectrum converter 402 of FIG. 4 is used to perform Operation 902. One of four conversion methods as described above for the spectrum/LSP converter 404 of FIG. 4 is used to perform Operation 904. The method used in Operation 902 determines the method used in Operation 904.

If the received speech packet does not have an erased frame (Operation 901), an LSP parameter of a current frame is decoded (Operation 906), and the decoded LSP parameter is provided as the LSP parameter of the current frame (Operation 907).

Figure 10:
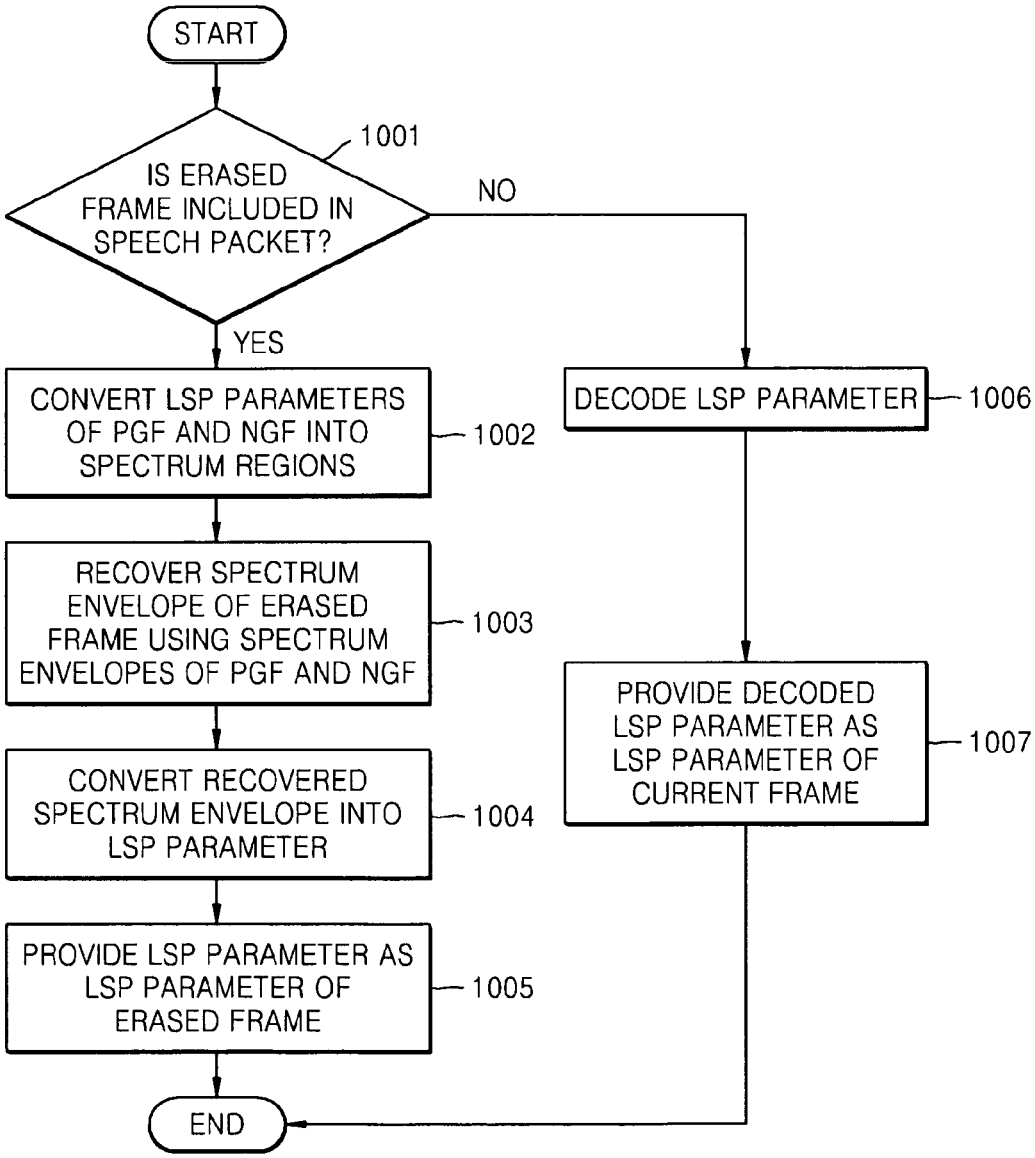
FIG. 10 is a flowchart of a method of recovering an LSP parameter according to another embodiment of the present invention.

FIG. 10 is a flowchart of a method of recovering an LSP parameter according to another embodiment of the present invention. Referring to FIG. 10, if it is determined that a received speech packet has an erased frame during speech decoding (Operation 1001), an LSP parameter of a PGF and an LSP parameter of an NGF are converted into spectrum regions to obtain spectrum envelopes of the PGF and the NGF (Operation 1002).

The obtained spectrum envelopes of the PGF and the NGF are used to recover a spectrum envelope of the erased frame (Operation 903) using one of the methods described above for the recovering unit 504 of FIG. 5 and the recovering unit 704 in FIG. 7.

The recovered spectrum envelope of the erased frame is converted into an LSP parameter (Operation 1004) and the LSP parameter is provided as a recovered LSP parameter of the erased frame (Operation 1005).

One of four conversion methods described above for the LSP/spectrum converter 402 of FIG. 4 is used to perform Operation 1002. One of four conversion methods described above for the spectrum/LSP converter 404 of FIG. 4 is used to perform Operation 1004. The method used in Operation 1002 determines the method used in Operation 1004.

If the received speech packet does not have an erased frame (Operation 1001), an LSP parameter of a current frame is decoded (Operation 1006), and the decoded LSP parameter is provided as the LSP parameter of the current frame (Operation 1007).

Methods of the present invention can also be embodied as a computer readable storage medium including computer readable code. A computer readable recording medium is any data storage device that can store data which can be thereafter read by a computer system. Examples of the computer readable recording medium include read-only memory (ROM), random-access memory (RAM), CD-ROMs, magnetic tapes, floppy disks, and optical data storage devices. The computer readable recording medium can also be a distributed network coupled computer system so that the computer readable code is stored and executed in a distributed fashion.

The above-described embodiments of the present invention can improve the quality of a recovered speech signal, be applied to a variety of technologies, and provide a method of recovering an LSP parameter for the easy development of an algorithm for speech decoding.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. A method of recovering a line spectrum pair (LSP) parameter for speech decoding, the method comprising:

recovering a spectrum envelope of an erased frame using an obtained spectrum envelope of a previous good frame (PGF) of the erased frame, the obtained spectrum being based on a conversion of an LSP parameter of the PGF into a spectrum region of the PGF; and converting the recovered spectrum envelope of the erased frame into an LSP parameter of the erased frame.

2. The method of claim 1, wherein the spectrum envelope of the erased frame is recovered by spectral shifting the obtained spectrum envelope of the PGF to a predetermined region.

3. The method of claim 1, wherein the spectrum envelope of the erased frame is recovered by transforming the obtained spectrum envelope of the PGF using a weight determined according to the correlation between the erased frame and the PGF.

4. The method of claim 1, wherein the obtained spectrum is based on:

a converting of the LSP parameter of the PGF into a linear predictive coefficient (LPC) of the PGF;

a converting of the LPC of the PGF into a Cepstrum of the PGF; and a converting of the Cepstrum of the PGF into a spectrum region and an obtaining of the spectrum envelope of the PGF, and wherein the converting of the recovered spectrum envelope comprises:

converting the spectrum envelope of the erased frame into a Cepstrum of the erased frame;

converting the Cepstrum of the erased frame into the LPC of the erased frame; and converting the LPC of the erased frame into the LSP parameter.

5. The method of claim 2, wherein the obtained spectrum is based on:

a converting of the LSP parameter of the PGF into a linear predictive coefficient (LPC) of the PGF;

a converting of the LPC of the PGF into a Cepstrum of the PGF; and a converting of the Cepstrum of the PGF into a spectrum region and an obtaining of the spectrum envelope of the PGF, and wherein the converting of the recovered spectrum envelope comprises:

converting the spectrum envelope of the erased frame into a Cepstrum of the erased frame;

converting the Cepstrum of the erased frame into the LPC of the erased frame; and converting the LPC of the erased frame into the LSP parameter.

6. The method of claim 3, wherein the obtained spectrum is based on:

a converting of the LSP parameter of the PGF into a linear predictive coefficient (LPC) of the PGF;

a converting of the LPC of the PGF into a Cepstrum of the PGF; and a converting of the Cepstrum of the PGF into a spectrum region and an obtaining of the spectrum envelope of the PGF, and wherein the converting of the recovered spectrum envelope comprises:

converting the spectrum envelope of the erased frame into a Cepstrum of the erased frame;

converting the Cepstrum of the erased frame into the LPC of the erased frame; and converting the LPC of the erased frame into the LSP parameter.

7. The method of claim 1, wherein the obtained spectrum is based on:

a converting of the LSP parameter of the PGF into a linear predictive coefficient (LPC) of the PGF;

a converting of the LPC of the PGF into a spectrum region and an obtaining the spectrum envelope of the PGF, and wherein the converting of the recovered spectrum envelope comprises:

converting the spectrum envelope of the erased frame into an auto-correlation coefficient converting the ACC of the erased frame into the LPC of the erased frame; and converting the LPC of the erased frame into the LSP parameter of the erased frame.

8. The method of claim 1, wherein the obtained spectrum is based on:

a converting of the LSP parameter of the PGF into a linear predictive coefficient (LPC) of the PGF;

a converting of the LPC of the PGF into a Cepstrum of the PGF; and a converting of the Cepstrum into a spectrum region and an obtaining of the spectrum envelope of the PGF, and wherein the converting of the recovered spectrum envelope comprises:

converting the spectrum envelope of the erased frame into an auto-correlation coefficient (ACC) of the erased frame;

converting the ACC of the erased frame into the LPC of the erased frame; and converting the LPC of the erased frame into the LSP parameter of the erased frame.

9. The method of claim 1, wherein the obtained spectrum is based on:

a converting of the LSP parameter of the PGF into a pseudo cepstrum (PCEP) of the PGF; and a converting of the PCEP of the PGF into a spectrum region and an obtaining of the spectrum envelope of the PGF, and wherein the converting of the recovered spectrum envelope comprises:

converting the spectrum envelope of the erased frame into a PCEP of the erased frame; and converting the PCEP of the erased frame into the LSP parameter of the erased frame.

10. A method of recovering a line spectrum pair (LSP) parameter in speech decoding, the method comprising:

recovering a spectrum envelope of an erased frame using obtained spectrum envelopes of a previous good frame (PGF) of the erased frame and a next good frame (NGF) of the erased frame, the obtained spectrum envelopes being based on a conversion of an LSP parameter of the PGF and an LSP parameter of the NGF into spectrum regions; and converting the recovered spectrum envelope of the erased frame into an LSP parameter of the erased frame.

11. The method of claim 10, wherein the recovering of the spectrum envelopes comprises:

transforming the spectrum envelope of the PGF using a first weight determined according to the correlation between the erased frame and the PGF and the correlation between the erased frame and the NGF;

transforming the spectrum envelope of the NGF using a second weight determined according to the correlations; and combining the transformed spectrum envelope of the PGF and the transformed spectrum envelope of the NGF to obtain the combined spectrum envelope as the recovered spectrum envelope of the erased frame.

12. The method of claim 10, wherein the spectrum envelope of the erased frame is recovered by nonlinearly matching a spectrum band of the PGF and a spectrum band of the NGF using a dynamic method.

13. The method of claim 10, wherein the obtained spectrum envelopes are based on:

a converting of the LSP parameters of the PGF and the NGF into linear predictive coefficients (LPCs) of the PGF and NGF;

a converting of the LPCs of the PGF and the NGF into Cepstrums of the PGF and the NGF; and a converting of the Cepstrums into spectrum regions of the PGF and the NGF and an obtaining of the spectrum envelopes of the PGF and the NGF, and wherein the converting of the recovered spectrum envelope comprises:

converting the spectrum envelope of the erased frame into the Cepstrum of the erased frame;

converting the Cepstrum of the erased frame into the LPC of the erased frame; and converting the LPC of the erased frame into the LSP parameter of the erased frame.

14. The method of claim 10, wherein the obtained spectrum envelopes are based on:

a converting of the LSP parameters of the PGF and the NGF into linear predictive coefficients (LPCs) of the PGF and the NGF; and a converting of the LPCs into spectrum regions and an obtaining the spectrum envelopes of the PGF and the NGF, and wherein the converting of the recovered spectrum envelope comprises:

converting the spectrum envelope of the erased frame into an auto-correlation coefficient (ACC) of the erased frame;

converting the ACC of the erased frame into the LPC of the erased frame; and converting the LPC of the erased frame into the LSP parameter of the erased frame.

15. The method of claim 11, wherein the obtained spectrum envelopes are based on:

a converting of the LSP parameters of the PGF and the NGF into linear predictive coefficients (LPCs) of the PGF and the NGF; and a converting of the LPCs into spectrum regions and an obtaining of the spectrum envelopes of the PGF and the NGF, and wherein the converting of the recovered spectrum envelope comprises:

converting the spectrum envelope of the erased frame into an auto-correlation coefficient (ACC) of the erased frame;

converting the ACC of the erased frame into the LPC of the erased frame; and converting the LPC of the erased frame into the LSP parameter of the erased frame.

16. The method of claim 12, wherein the obtained spectrum envelopes are based on:

a converting of the LSP parameters of the PGF and the NGF into linear predictive coefficients (LPCs) of the PGF and the NGF; and a converting of the LPCs into spectrum regions and an obtaining of the spectrum envelopes of the PGF and the NGF, and wherein the converting of the recovered spectrum envelope comprises:

converting the spectrum envelope of the erased frame into an auto-correlation coefficient (ACC) of the erased frame;

converting the ACC of the erased frame into the LPC of the erased frame; and converting the LPC of the erased frame into the LSP parameter of the erased frame.

17. The method of claim 10, wherein the obtained spectrum envelopes are based on:

a converting of the LSP parameters of the PGF and the NGF into linear predictive coefficients (LPCs) of the PGF and the NGF;

a converting of the LPCs of the PGF and the NGF into Cepstrums of the PGF and the NGF; and a converting of the Cepstrums into spectrum regions of the PGF and the NGF and an obtaining of the spectrum envelope of the PGF and the NGF, and the converting of the recovered spectrum envelope comprises:

converting the spectrum envelopes of the erased frame into an auto-correlation coefficient (ACC) of the erased frame;

converting the ACC of the erased frame into the LPC of the erased frame; and converting the LPC of the erased frame into the LSP parameter of the erased frame.

18. The method of claim 10, wherein the obtained spectrum envelopes are based on:

a converting of the LSP parameters of the PGF and the NGF into pseudo cepstrums (PCEPs) of the PGF and the NGF; and a converting of the PCEPs into spectrum regions of the PGF and the NGF and an obtaining of the spectrum envelopes of the PGF and the NGF, and the converting of the recovered spectrum envelope comprises:

converting the spectrum envelope of the erased frame into the PCEP of the erased frame; and converting the PCEP of the erased frame into the LSP parameter of the erased frame.

19. An apparatus, including at least one processing device, for recovering a line spectrum pair (LSP) parameter during speech decoding, the apparatus comprising:

a spectrum recovering unit using the at least one processing device to recover a spectrum envelope of an erased frame using an obtained spectrum envelope of a previous good frame (PGF) of the erased frame, the obtained spectrum being based on a conversion of an LSP parameter of the PGF into a spectrum region of the PGF; and a converter to convert the spectrum envelope of the erased frame into an LSP parameter of the erased frame.

20. The apparatus of claim 19, wherein the spectrum recovering unit recovers the spectrum envelope of the erased frame by spectral shifting the spectrum envelope of the PGF to a predetermined region.

21. The apparatus of claim 19, wherein the spectrum recovering unit transforms the obtained spectrum envelope of the PGF using a weight determined according to the correlation between the erased frame and the PGF and outputs the transformed spectrum envelope as the recovered spectrum envelope of the erased frame.

22. An apparatus, including at least one processing device, for recovering a line spectrum pair (LSP) parameter in speech decoding, the apparatus comprising:

a recovering unit, using the at least one processing device, to recover a spectrum envelope of the erased frame using obtained spectrum envelopes of a previous good frame (PGF) of the erased frame and a next good frame (NGF) of the erased frame, the obtained spectrum envelopes being based on a conversion of an LSP parameter of the PGF and an LSP parameter of the NGF into spectrum regions; and a converter to convert the recovered spectrum envelope of the erased frame into an LSP parameter region of the erased frame.

23. The apparatus of claim 22, wherein the recovering unit comprises:

a first transformer transforming the spectrum envelope of the PGF using a first weight determined according to the correlation between the erased frame and the PGF and the correlation between the erased frame and the NGF;

a second transformer transforming the spectrum envelope of the NGF using a second weight determined according to the correlations; and a combiner combining the transformed spectrum envelope of the PGF and the transformed spectrum envelope of the NGF to obtain the combined spectrum envelope as the recovered spectrum envelope of the erased frame.

24. The apparatus of claim 22, wherein the recovering unit recovers the spectrum envelope of the erased frame by non-linearly matching a spectrum band of the PGF and a spectrum band of the NGF using a dynamic method.

25. A speech decoding apparatus including at least one processing device, comprising:

an excitation signal decoder decoding parameters of a current frame and outputting an excitation signal;

a line spectrum pair (LSP) parameter decoder decoding an LSP parameter of the current frame;

a frame erasure concealment unit, using the at least one processing device, configured such that when a received coded speech packet has an erased frame, to recover an LSP parameter of the erased frame and the excitation signal of the erased frame using parameters of a previous good frame (PGF) and a next good frame (NGF) of the erased frame in order to conceal the erasure of the erased frame;

a parameter transmitter, when the received coded speech packet does not have an erased frame, transmitting the parameters of the current frame to the excitation signal decoder and the LSP parameter decoder and, if the received coded speech packet has the erased frame, transmitting the parameters of the PGF and the NGF of the erased frame to the frame erasure concealment unit;

a converter converting the decoded LSP parameters transmitted from the LSP parameter decoder or the LSP parameter transmitted from the frame erasure concealment unit into an LPC; and a combination filter receiving the excitation signal output from the excitation signal decoder or the excitation signal output from the frame erasure concealment unit and outputting a combined speech signal using the LPC output from the converter.

26. A non-transitory computer-readable recording medium encoded with processing instructions for causing a processor to execute a method of recovering a line spectrum pair (LSP) parameter for speech decoding, the method comprising:

recovering a spectrum envelope of the erased frame using an obtained spectrum envelope of a previous good frame (PGF) of the erased frame, the obtained spectrum being based on a conversion of an LSP parameter of the PGF into a spectrum region of the PGF; and converting the recovered spectrum envelope of the erased frame into an LSP parameter of the erased frame.

27. A non-transitory computer-readable recording medium encoded with processing instructions for causing a processor to execute a method of recovering a line spectrum pair (LSP) parameter in speech decoding, the method comprising:

recovering a spectrum envelope of an erased frame using obtained spectrum envelopes of a previous good frame (PGF) of the erased frame and a next good frame (NGF) of the erased frame, the obtained spectrum envelopes being based on a conversion of an LSP parameter of the PGF and an LSP parameter of the NGF into spectrum regions; and converting the recovered spectrum envelope of the erased frame into an LSP parameter of the erased frame.

* * * * *

UNITED STATES PATENT AND TRADEMARK OFFICE

CERTIFICATE OF CORRECTION

PATENT NO. : 8,214,203 B2
APPLICATION NO. : 12/659943
DATED : July 3, 2012
INVENTOR(S) : Hosang Sung et al.

It is certified that error appears in the above-identified patent and that said Letters Patent is hereby corrected as shown below:

Title Page Col. 1 (Inventors), Line 1, Delete "Youngin-si (KR);" and insert -- Yongin-si (KR); --, therefor.
Column 10, Line 24, In Claim 7, after "coefficient" insert -- (ACC) of the erased frame; --.
Column 10, Line 49, In Claim 9, delete "cepstrum" and insert -- Cepstrum --, therefor.
Column 12, Line 46, In Claim 18, delete "cepstrums" and insert -- Cepstrums --, therefor.

Signed and Sealed this
Twentieth Day of November, 2012

David J. Kappos

David J. Kappos
*Director of the United States Patent and Trademark Office*